United States Patent [19]

Hart

[11] Patent Number: 4,956,948

[45] Date of Patent: Sep. 18, 1990

[54] CLOG RESISTANT GUTTER-DOWNSPOUT CONNECTION UNIT

[76] Inventor: Richard Hart, 3497 Citrus Dr., Duluth, Ga. 30136

[21] Appl. No.: 424,528

[22] Filed: Oct. 19, 1989

[51] Int. Cl.[5] ..... E04D 13/08

[52] U.S. Cl. ..... 52/16; 52/11; 52/12; 210/162; 210/163; 285/176; 285/177; 285/424

[58] Field of Search ..... 52/16, 12, 195, 197, 52/11; 285/176, 177, 424; 210/162, 163

[56] References Cited

U.S. PATENT DOCUMENTS

| | | | |
|---|---|---|---|
| 4,526,091 | 7/1985 | Sharp | 285/424 |
| 4,769,526 | 9/1988 | Taouil | 52/11 |

FOREIGN PATENT DOCUMENTS

| | | | |
|---|---|---|---|
| 837594 | 4/1952 | Fed. Rep. of Germany | 52/16 |
| 1226049 | 7/1960 | France | 52/16 |

*Primary Examiner*—Carl D. Friedman
*Assistant Examiner*—Deborah M. Ripley
*Attorney, Agent, or Firm*—Hurt, Richardson, Garner, Todd & Cadenhead

[57] ABSTRACT

An improved gutter-downspout connection unit to be used in connecting a conventional gutter to a conventional downspout in rain water removal systems which is generally anvilar in structure comprising an upper body having first and second upper body sides and first and second end pieces with at least one of the end pieces having a smooth curvature which downwardly and inwardly converges towards the other end piece wherein the upper body sides and the end pieces adjoin each other along common edges such that the upper edges of the upper body sides and the end pieces form a common edge defining a top opening, and the lower edges of the upper body sides and the end pieces form a common edge defining a bottom opening substantially opposite the top opening, such that and debris and water contained in the conventional gutter will follow a curved path from the gutter to the downspout thereby making the gutter-downspout connection unit essentially clog-resistant.

10 Claims, 3 Drawing Sheets

CLOG RESISTANT GUTTER-DOWNSPOUT CONNECTION UNIT

BACKGROUND OF THE INVENTION

1. Field of the Invention

This invention relates to the removal of water from roofs by gutter-downspout systems in general and to the alleviation of the problem of clogging of the gutter-downspout union by leaves, twigs and other debris in particular.

2. Prior Art

Two common methods for removing water runoff, generally rain, from a roof are the scupper and the gutter-downspout. Runoff should not be considered "guttered" until it leaves the roof. Up to that point it may or may not be channeled depending on the roof shape. A gutter channels the runoff to the mouth of the downspout. A scupper is not a gutter or part of the guttering component, but is generally a hole located in the facade of the top of the building which allows passage of runoff from the roof. An "open" scupper has two sides and a bottom spout-like component, forming what can be likened to a "U"-shaped channel through the building's facade. A "closed" scupper also includes a top or roof portion, thus defining a tunnel-like opening in the building's facade. An open scupper is less likely to become clogged, not having the top or roof on which debris can catch. Generally, a scupper channels the runoff to the "conductor" on the top edge of a downspout, but may just allow the runoff to fall directly to the ground.

The scupper-conductor method is not now, nor is likely to become, in widespread use because it only can be used where the roof or roof/facade is built in such a way as to channel the runoff to scuppers. Holding back the runoff while it is being channeled can add load to the roof structure and can encourage leaks and a shortened roof life. Additionally, if the scuppers were to become clogged, even only partially, the resulting backup of runoff could collapse the roof.

The common gutter-downspout system generally consists of a gutter horizontally attached to the building's facade and a downspout vertically attached to the building. The downspout is connected to the gutter via a hole cut in the bottom of the gutter trough which allows the roof runoff water contained in the gutter to leave the gutter by traveling vertically down the downspout to the ground. Various accessories can be attached to the gutter-downspout system, including "elbows" or bends in the downspout to alter the flow direction of the runoff in the downspout and splash blocks to lessen ground erosion where the runoff leaves the lower end of the downspout and contacts the ground.

In the gutter-downspout system, the runoff is discharged directly from the roof to the gutter. In the scupper-conductor system, the runoff is channeled along the inside surface of the building's facade to the scuppers. The gutter-downspout system uses a horizontal flow path for the runoff by means of a gutter which is commonly up to 50 feet long and sometimes longer. The scupper-conductor system uses a vertical flow path (free fall) for the runoff by means of a conductor which is usually only 12 inches to 14 inches high. As a result of the free fall and impact the flow becomes highly turbulent. Because of the scuppers and the turbulence, the scupper-conductor system is poor at removing debris, especially pine straw and small twigs.

The weakest links in the scupper-conductor and the gutter-downspout systems with regard to the removal of debris entrained in the runoff are the interfaces between the scupper and the conductor and the gutter and the downspout. Debris, such as leaves, twigs, and pine needles, is carried off of the roof and into the gutter or scupper with the runoff. Assuming the debris does not get caught or trapped in the gutter or scupper itself, the debris will be carried to the downspout or conductor along with the runoff. In the gutter-downspout system, there generally is a ninety degree (90°) connection between the gutter and the downspout and the hole in the lower trough surface of the gutter leading to the downspout generally is about three inches (3″) square. This configuration is susceptible to "bridging" by the debris across the opening in the gutter to the downspout and subsequent clogging of the downspout, thus reducing or blocking the flow of the runoff through the downspout.

SUMMARY OF THE INVENTION

The Parabolic Gutter-Downspout Attachment (or PGDA) or clog resistant gutter-downspout connection unit invention disclosed herein is an attachment at the junction of a rain gathering gutter and a downspout pipe. The term "parabolic" refers to the curved shape of certain of the sides of the invention and the curved flow path taken by the runoff as it travels through the gutter, then the PGDA, then the downspout, and is not intended to limit the shape of any portion of this invention to the mathematical definition of "parabola."

In brief, the connection unit of the present invention is a generally anvil-shaped hollow funnel with a generally rectangular horizontal cross-section, with the rectangular cross-sections decreasing in area from the top or mouth of the unit to the bottom or throat of the unit. The top or mouth of the unit is attached to the bottom of the trough of a conventional gutter, and the bottom or throat of the unit connects to a conventional downspout. The cross-sectional area of the top or mouth of the unit is relatively large when compared to a conventional gutter/downspout interface. This larger cross-sectional area coupled with the curved shape of at least two of the sides of the unit combine to discourage clogging of the unit by debris and to allow flow even if the unit is bridged by larger debris such as larger twigs.

The PGDA diverts the flow from the gutter to the downspout in such a manner as to encourage this change of direction. Debris, such as leaves and pine needles, contained within the flow is also diverted to the downspout and is discouraged from remaining behind. The effectiveness of the debris removal is greatly increased as the flow rate rises as would normally occur during a heavy rain. A main purpose of the design is to greatly improve the rainwater and debris removal of a guttering system over that of existing non-mechanical methods.

The PGDA removes rainwater and the normal kind of debris that finds its way into a gutter by:

1. increasing the flow speed of the rainwater/debris by using a smooth downward-curved surface that minimizes turbulence (friction) and separation;

2. discouraging "bridging" of the debris by providing a relatively wide curved mouth; and 3. resisting clogging by creating head pressure that increases as the throat narrows to meet the downspout.

The PGDA mouth is dimensionally different from its gutter and is smoothly curved to prevent turbulence. The PGDA method uses about three (3) inches or higher of head pressure from the gutter plus about three (3) inches or more of head pressure in the mouth.

Accordingly, it is an object of the present invention to provide a gutter-downspout connecting unit which minimizes or eliminates the tendency for bridging of debris at the gutter-downspout interface.

It is another object of the present invention to provide a gutter-downspout connecting unit which facilitates the removal of debris from the system and is essentially clog resistant.

It is a further object of the present invention to provide a gutter-downspout connecting unit which is easily adaptable for use in any gutter-downspout system.

It is yet another object of the present invention to provide a gutter-downspout connecting unit which facilitates the flow of runoff from the gutter to the downspout.

It is an additional object of the present invention to provide a gutter-downspout connecting unit which is durable in construction, efficient in operation and inexpensive to manufacture.

Other objects, features, and advantages of the present invention will become apparent from the following description when taken in conjunction with the accompanying drawings wherein like characters of reference designate corresponding parts throughout the several views.

DETAILED DESCRIPTION OF THE PREFERRED EMBODIMENTS

Figure 1A:
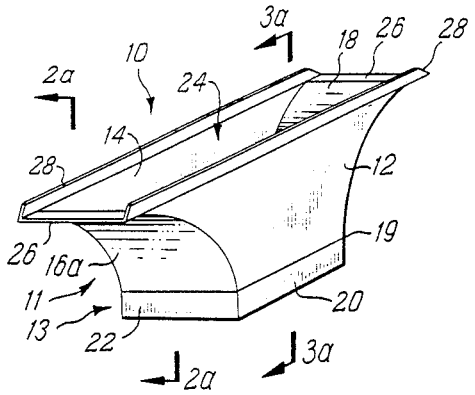
FIG. 1*a* is a perspective view of the present invention in a configuration suitable for mounting in the center of a section of guttering.

With reference to FIGS. 1–7, wherein like numerals represent like parts, the gutter-to-downspout connection unit of the present invention, indicated generally by the number 10, may be made of any material suitable for outdoor use, such as plastic, aluminum, galvanized steel, or the like, and may be colored, painted, or otherwise finished in order to present a desired appearance. The connection unit 10 preferably is substantially anvilar in shape, and comprises one component or a plurality of components, such that the component is, or the components, if a plurality, forms, a structure comprising an upper body 11 and a lower body 13 integrally connected to each other along common edge 19.

With reference now to FIGS. 1, 2, 3, and 4 depicting the preferred embodiments of the present invention, the connection unit 10 comprises an upper body 11, which is a generally anvil-shaped hollow funnel comprising first and second flat sides 12, 14, first and second parabolic ends 16, 18, together forming or defining a mouth or entrance opening 24, and a lower body 13, which is a hollow tube, generally rectangular in cross section, comprising four integrally connected, generally rectangular sides 20, 21, 22, 23 forming a throat or neck 25, which is integrally attached to the lower peripheral edge of upper body 11 at common edge 19.

The first flat side 12, second flat side 14, first parabolic end 16, and second parabolic end 18, are joined integrally together as the upper body 11, which forms or defines the mouth or entrance opening 24 of the connection unit 10. The first flat side 12 and second flat side 14 are located opposite each other on the upper body 11, and generally are located in parallel planes. The first parabolic end 16 and the second parabolic end 18 are located opposite each other on the upper body 11, and are downwardly converging toward and parallel to each other relative to a horizontal line located in a vertical plane equidistant from the two ends 16, 18. As mentioned previously, the term "parabolic" refers to the general curved shape of at least two of the sides of the present invention and is not meant to limit the shape of any of the side of the present invention to the mathematical definition of "parabola."

Figure 1B:
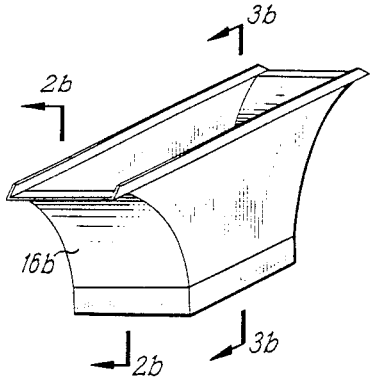
FIG. 1*b* is a perspective view of the present invention in a configuration suitable for mounting at the end of a section of guttering.

The first flat side 12 and the second flat side 14 are substantially the same size and shape with first flat side 12 being a mirror image of second flat side 14 in both of the two preferred embodiments, as depicted in FIG. 1*a* and FIG. 1*b*, respectively. The upper edges of flat sides 12, 14 generally are about 11 to 15 inches in length. The lower edge of the flat sides 12, 14, as defined by common edge 19, generally are about 2 to 4 inches in length, depending on the dimensions of the downspout 34 attached to the lower edge of the lower body 13 of connection unit 10. The upper edges and the lower edges of the flat sides 12, 14 are parallel to each other, and the height of the flat sides 12, 14, along a line perpendicular to both the upper and lower edges, ranges from about three (3) inches to about twelve (12) inches depending upon the application.

Figure 2A:
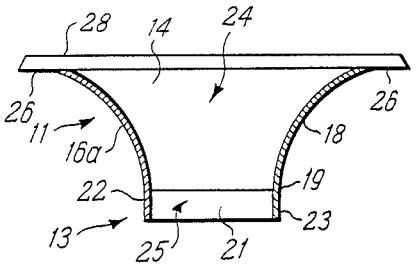
FIG. 2*a* is a sectional view of the present invention along line 2*a*—2*a* of FIG. 1*a*.
Figure 2B:
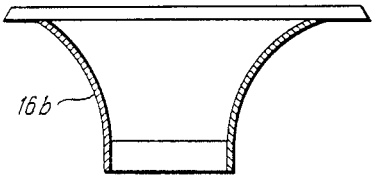
FIG. 2*b* is a sectional view of the present invention along line 2*b*—2*b* of FIG. 1*b*.

The second parabolic end 18 is identical in both preferred embodiments as shown in FIGS. 2*a* and 2*b*. The curvature of the parabola end 18 is relatively unimportant as long as the curve is smooth along its length. In the embodiment of the connection unit 10 depicted in FIGS. 1*a* and 2*a*, first parabolic end 16*a* is the equivalent mirror image of second parabolic end 18. The configuration of the connection unit 10 embodied in FIGS. 1*a* and 2*a* generally is used where the connection unit 10 is located centrally along a relatively long portion of gutter 30.

In the second preferred embodiment of the connection unit 10, as depicted in FIGS. 1*b* and 2*b*, the first parabolic end 16b is of a different size curve than the second parabolic end 18. In this embodiment, the curvature of the first parabolic end 16b is more gradual than the curvature of the second parabolic end 18; that is, the curvature of the first parabolic end 16 is less pronounced. This second embodiment is, therefore, somewhat shorter in length along the top edge of flat sides 12, 14 when compared to the first embodiment. The configuration of the second embodiment as depicted in FIGS. 1b and 2b is generally suitable when the connection unit 10 is placed on the end of a length of gutter 30 as depicted in FIGS. 4a and 5a.

In both preferred embodiments, the upper edges of parabolic ends 16, 18 are approximately the same length as the width of the lower trough surface of a typical gutter. In practice, a width of about 3 to 4 inches will fit most applications. Thus, the entire connection unit 10 generally can fit within an imaginary box whose dimensions are approximately 11 to 15 inches long, 6 to 12 inches high, and 3 to 4 inches wide.

In general, the width of the downspout 34 is the same or nearly identical to the width of the bottom trough of the gutter 30 and flat sides 12, 14 are located in parallel planes. Therefore, the width of the upper edges of parabolic sides 16, 18 is approximately the same as the width of the lower trough surface of gutter 30, and the width of the lower body 13 is generally the same as the downspout 34. However, if the width of the downspout 34 is less than the width of the bottom trough of the gutter 30, flat sides 12, 14 must downwardly converge inwardly towards each other before becoming integrated with the lower body 13 at common edge 19. If the convergence is necessary, the flat sides 12, 14 generally are downwardly converging toward and parallel to each other relative to a horizontal line located in a vertical plane equidistant from flat sides 12, 14. Such a convergence is necessary when the width of the downspout 34 is smaller than the width of the common gutter 30.

Likewise, if the downspout 34 is narrower in width than the gutter 30 then, necessarily, parabolic ends 16, 18 also must narrow between the upper edges of the parabolic ends 16, 18 contacting the gutter 30 and the lower edges of the parabolic ends 16, 18 which are integrally joined with the lower body 13 at common edge 19. The downward convergence of flat sides 12, 14, if necessary, also can be accomplished by a parabolic or other suitable shape and, therefore, the term "flat" in flat sides 12, 14 is merely for nomenclature purposes only.

The lower peripheral edge of the upper body 11 is integrally connected along common edge 19 to the upper peripheral edge of the hollow, generally rectangular in cross section, lower body 13, thus forming an exit opening from the mouth or entrance opening 24 to the neck or throat 25. For relative size purposes, the upper peripheral edge of the upper body 11, defining the mouth or entrance opening 24, is larger in perimeter and area than the lower peripheral edge of the upper body 11 and the upper peripheral edge of the lower body 13 defined by common edge 19. The lower peripheral edge of the lower body 13 is the same size and shape as the upper peripheral edge of the lower body 13.

The lower body 13, defining the neck or throat 25, comprises a first lower side 20, a second lower side 21, a third lower side 22, and a fourth lower side 23. First and third lower sides 20, 21 are generally rectangular in shape, are substantially equal in size and shape to each other, and are located opposite each other and in parallel vertical planes relative to the vertical axis a of the neck or throat 25 of the lower body 13. Second and fourth lower sides 22, 23 also are generally rectangular in shape, are substantially equal in size and shape to each other, and are located opposite each other and in parallel vertical planes relative to the neck or throat 25 of the lower body 13. Thus, the lower body forms a generally hollow conduit which is generally rectangular in cross section.

Lower body 13 of the connection unit 10 is of a size and configuration such that it can be releasibly attached to the typical downspout 34 or can be fit inside a conventional downspout 34, with the outer peripheral wall of the lower body 13 frictionally engaging the inner peripheral wall of the conventional downspout 34. In this regard, lower body 13 can be of a variety of sizes and shapes depending on the current application. For example, if the downspout 34 is a nominal 2" by 3" downspout, the lower body 13 will have dimensions approximating 2" by 3" so that it may be releasibly secured to the downspout 34. For such 2" by 3" downspout, the flat sides 12, 14 and the parabolic ends 16, 18 will downwardly converge to a lower body 13 of dimensions of approximately 2" by 3" and at common edge 19 the lower peripheral of the upper body 11 also will be approximately 2" by 3".

Support tabs 26 are located on and integrally attached to the upper edges of the first and second parabolic ends 16, 18. Support tabs 26 are defined by a generally horizontal, rectangular plane and are of the same length as the width of first and second parabolic ends 16, 18, and are of a width sufficient to engage the lower trough surface of a gutter 30, generally approximately one-quarter to one inch ($\frac{1}{4}$"$-$1"), such that the connection unit 10 is supported in an opening in the lower trough surface of the gutter 30 by support tabs 26.

Side tabs 28 are located on and integrally attached to the upper edges of the first and second flat sides 12, 14. Side tabs 28 are defined by a generally vertical, rectangular plane, and are of the same length as the width of the upper edges of first and second flat sides 12, 14, and are of a height sufficient to engage the side walls of a gutter 30, generally approximately one-quarter to one inch ($\frac{1}{4}$"$-$1"), such that adhesive and/or sealant means can be placed on side tabs 28 to seal the connection unit 10 onto the gutter 30. Adhesive and/or sealant means are also placed between support tabs 26 and the lower trough surface of the gutter 30.

Figure 4B:
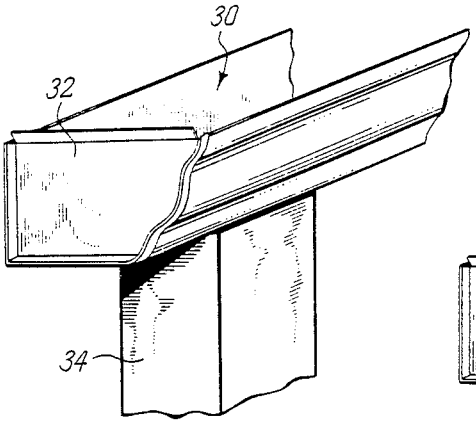
FIG. 4b (PRIOR ART)
FIG. 4*b* is a perspective view of a conventional gutter downspout system.
Figure 5B:
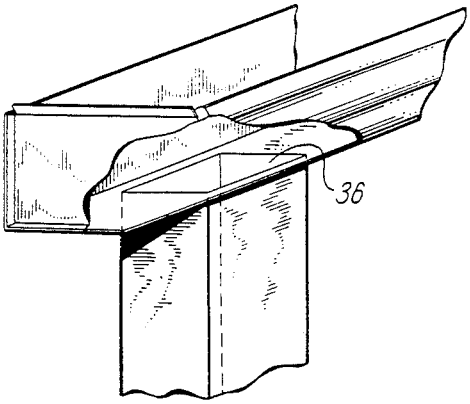
FIG. 5b (PRIOR ART)
FIG. 5*b* is a perspective view, partly in section, of a typical gutter downspout system.
Figure 4A:
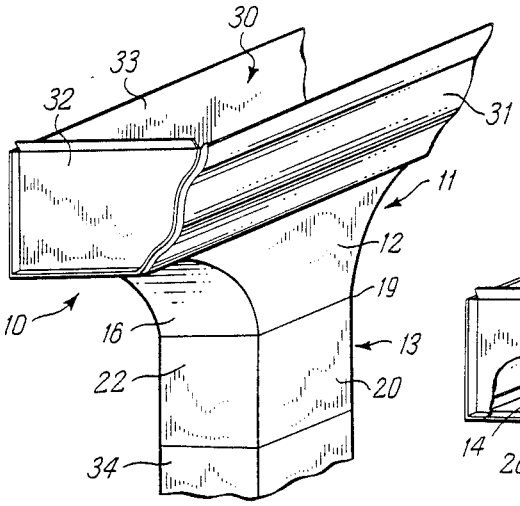
FIG. 4*a* is a perspective view of the present invention as it would be used in connection with a typical gutter and downspout system.
Figure 5A:
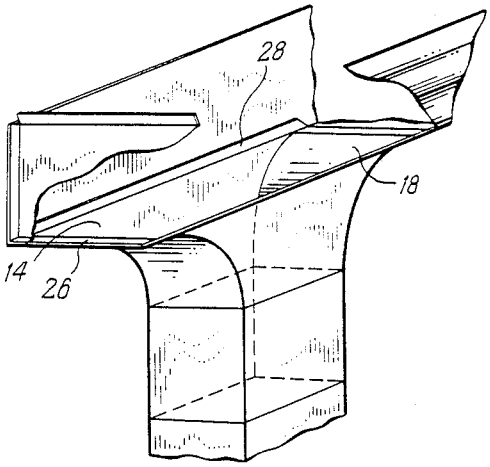
FIG. 5*a* is a perspective view, partly in section, of the present invention in connection with a typical gutter and downspout system.

FIGS. 4 and 5 depict the operation of the present invention compared to the operation of a conventional gutter downspout system. FIG. 4a is a perspective view of the connection unit 10 attached to a typical gutter and FIG. 5a is a cross section corresponding to the system of FIG. 4a. FIG. 4b is a perspective view of a conventional gutter downspout system and FIG. 5b is a cross section corresponding to the system of FIG. 4b.

In installation as shown in FIG. 5a, a hole or opening is cut in the lower trough surface of gutter 30 large enough for the connection unit 10 to fit through but small enough such that support tabs 26 will engage the lower trough surface of the gutter 30 along the edges of the opening and will support the connection unit 10 within the gutter 30, thus preventing the connection unit 10 from falling though the hole or opening in the lower trough surface of the gutter 30.

In its best embodiment, the upper edge of parabolic ends 16, 18, which correspond to the "width" of the connection unit 10, is as wide as the bottom surface of the gutter 30 and therefore the hole or opening cut in the lower trough surface of gutter 30 extends from the front side 31 of the gutter 30 to the rear side 33 of the gutter 30. When connection unit 10 is placed within the hole cut in the lower surface of the gutter 30, sealing tabs 28 fit against the front wall 31 and the rear wall 33 of the gutter 30. A suitable outdoor adhesive such as a silicone seal, is applied between tab 28 and the front wall 31 and the rear wall 33 of the gutter 30 as well as between the support tabs 26 and the bottom surface of the gutter so as to prevent water from leading through the hole cut in the lower surface of the gutter 30.

If the connection unit 10 is being used as a replacement or substitute in a pre-existing gutter-downspout system, one simply cuts a hole or opening in the existing lower trough surface of the gutter 30 at a site in the immediate vicinity around where the existing downspout 34 is attached to the gutter 30. The size of the hole or opening depends on the exact connection unit 10 utilized but in any event should fall within the paramenters set forth above. It may be necessary to remove a portion of the existing downspout 34 as the dimensions of the connection unit 10 demand. The connection unit 10 then is dropped into the hole or opening in the lower trough surface of the gutter 30 with support tabs 26 engaging the edge of the hole or opening in the lower trough surface of the gutter 30. The connection unit 10 is sealed into place by placing adhesive and/or sealant means between support tabs 26 and the lower trough surface and between sealing tabs 28 and the side walls of the gutter 30. The connection unit 10 is then attached to the downspout 34. The connection of the lower body 13 of the connection unit 10 to the downspout 34 can be achieved by any conventional means, such as sealants, friction, or connecting materials or components.

If the connection unit 10 is being used as an original component of a guttering system, it is implemeted into the system in much the same way as described above for the replacement system. As an original component, there generally will be no need for removing portions of downspouts as a proper length of downspout can be prepared during the original installation.

In operation, as water flows into the gutter 30 from the roof surface, it naturally gravitates toward the mouth 24 of the upper body 11 of the connection unit 10 and down through the neck or throat 25 of the lower body 13 of the connection unit into the downspout 34. In a conventional gutter-downspout system the connection between the gutter 30 and the downspout 34 is shown generally by the number 36 in FIG. 5*b*. The hole defined by the connection 36 is only the size of the downspout 34, and is prone to clogging and bridging by leaves or twiggs carried off of the roof by the rain water.

The shape of the connection unit 10 of the present invention has several advantages in operation over the conventional gutter-downspout system, including a greatly increased mouth 24 cross sectional area which prevents clogging and bridging by leaves and twiggs carried off of the roof surface by the rain water. Additionally, the shape of the parabolic ends 16, 18 allow for the smooth flow of the water down into the connection unit 10 and subsequently into the downspout 34. The shape of the parabolic ends 16, 18 also directs the twigs and leaves from their horizontal flow along the gutter 30 smoothly into a vertical flow down through the connection unit 10 and into the downspout 34 thus eliminating the clogging and bridging potential in another way.

Should clogging occur within the downspout 34, such clogging will occur at the connection unit 10/downspout 34 interface a distance of three (3) or more inches below the level of water located in the gutter 30 due to the size and shape of the connection unit 10. The three (3) inches or more of water which backs up within the connection unit 10 over the clog in the downspout 34 plus the typical three (3) inches or so pressure head existing in the gutter 30 itself generally will generate sufficient head pressure within the downspout 34 so as to force the clog through and out of the downspout 34. As clogging generally occurs at the gutter/downspout interface in conventional gutter systems as shown in FIG. 5*b*, such an increased head is not available in conventional systems.

Figure 3A:
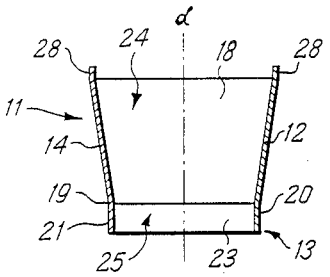
FIG. 3*a* is a sectional view of the present invention along line 3*a*—3*a* of FIG. 1*a*.
Figure 3B:
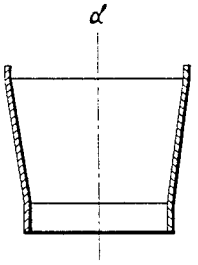
FIG. 3*b* is a sectional view of the present invention along line 3*b*—3*b* of FIG. 1*b*.
Figure 6:
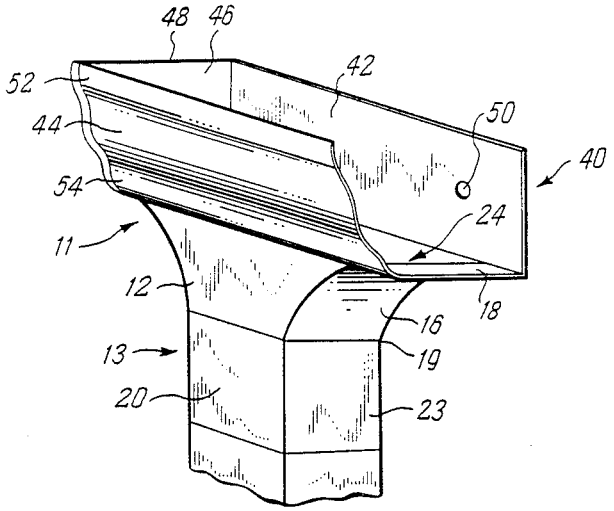
FIG. 6 is a perspective view of an alternate embodiment of the present invention, including an integral gutter component.
Figure 7:
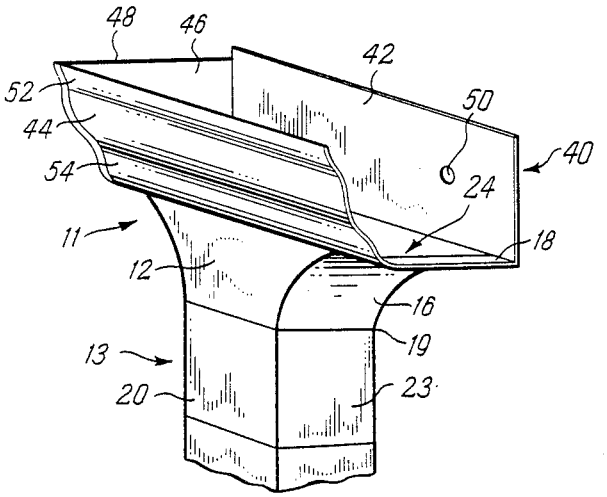
FIG. 7 is a perspective view of an alternate embodiment of the present invention, including an integral gutter component and forward spillway.

Two alternate embodiments of the present invention are shown in FIGS. 6 and 7. FIG. 6 incorporates a portion of the gutter 40 onto the top end of the connection unit upper body 11 so as to form an integral unit comprising a section of gutter 40, upper body 11, and lower body 13. The specific embodiments shown in FIGS. 6 and 7 are end units related to the embodiments shown in FIGS. 1*b*, 2*b* and 3*b*; however central units relating to FIGS. 1*a*, 2*a*, and 3*a* are also contemplated by the present invention.

Referring now to the first alternate embodiment as shown in FIG. 6, along with lower body 13 and upper body 11, which are substantially identical to the connection unit 10 described above, but without support tabs 26 and sealing tabs 28, this embodiment of the present invention incorporates a portion of gutter 40 consisting of gutter back wall 42, gutter front wall comprising lower edge 54, facade 44 and upper rim 52, and an end cap 46 located on the end of the gutter to prevent water from flowing off the end of the gutter. Optional mounting hole 50 allows mounting of the unit to the facade of the building.

The second alternate embodiment as shown in FIG. 7 is identical in structure to the embodiment depicted in FIG. 6 with the exception of a narrower rim 52. The purpose of having a narrower rim 52 allows the front and side edge portions 48 of the gutter portion 40 of the unit to be somewhat lower than both the rear wall 42 of the unit and the front wall 31 and rear wall 30 of the nominal gutter attached to the front of the house. The lower edge 48 creates an additional spillway which can be utilized in high flow situations; that is, when so much water leaves the roof and enters the gutter such that the gutter becomes full and the downspout cannot handle the flow, some of the water can flow over the overflow spillway 48 and be directed down the outside of the upper body 11, lower body 13, and downspout 34, and run down the downspout 34 to the ground. By having this lower spillway 48 the possibility of overflowing along the entire gutter length on the facade of the building is greatly reduced, as the overflow will naturally tend to occur at the spillway 48.

In operation, the alternate embodiments of FIGS. 6 and 7 are attached directly to the facade of the building with a downspout 34 being connected to the lower body 13 of the unit. In order to place these alternate embodiments on the facade of the building, a portion of the gutter already existing on the building, if there is existing gutter, equivalent to the length of the gutter portion 40 of the unit must be cut off of the gutter 30 to make room for the unit. Any connecting means such as metal or plastic bridges or silicone sealant can be used to connect the gutter Part 40 of the unit to the existing gutter 30 or to guttering 30 added at the same time as the unit. Mounting hole 50 can be provided to facilitate mounting the unit on the building's facade, or other conventional methods of mounting can be utilized.

It will be obvious to those skilled in the art that many variations may be made in the embodiments chosen for the purpose of illustrating the best mode of making and using the present invention without departing from the scope thereof as defined by the appended claims.

What is claimed is:

1. An improved gutter-downspout connection unit comprising first and second upper body sides and first and second end pieces, each of the upper body sides and end pieces having an upper edge, a lower edge and two side edges, the first and second upper body sides being substantially flat and located opposite and substantially parallel to each other, the first and second end pieces being located opposite each other with at least one of the end pieces having a smooth curvature which is convex inward continuously toward the other end piece about a longitudinal axis located outside of the unit until said end pieces are substantially parallel to each other;

wherein the upper body sides and the end pieces adjoin each other along the side edges forming a unitary, generally hollow structure such that the upper edges of the upper body sides and the end pieces form a first common edge defining a top opening, and the lower edges of the upper body sides and the end pieces form a second common edge defining a bottom opening, said bottom opening being substantially opposite the top opening.

2. The improved gutter-downspout connection unit as defined in claim 1, further comprising a lower body adjoining the upper body along a common edge, the lower body having first, second, third and fourth lower body sides which are substantially flat, each of the first, second, third and fourth lower body sides having an upper edge, a lower edge and two side edges, the first and second lower body sides being located opposite and substantially parallel to each other, and the third and fourth lower body sides being located opposite and substantially parallel to each other;

wherein the first, second, third and fourth lower body sides adjoin each other along the side edges such that the upper edges of the first, second, third and fourth lower body sides form a common edge defining a top opening, which top opening adjoins the bottom opening of the upper body along a common edge, and the lower edges of the first, second, third and fourth lower body sides form a common edge defining a lower opening.

3. The improved gutter-downspout connection unit as defined in claim 1, wherein both the end pieces have smooth curvatures which are convex inward toward each other about separate longitudinal axes located outside of the upper body and which taper inwardly toward each other and downwardly toward the common edge.

4. The improved gutter-downspout connection unit as defined in claim 1, further comprising first and second support tabs, the first support tab adjoining the upper edge of the third upper body end and the second support tab adjoining the upper edge of the fourth upper body end;

wherein each of the first and second support tabs defines a generally horizontal, rectangular plane, has a length substantially equal to the width of the third and fourth upper body sides, and has a width sufficient to engage a lower trough surface of a conventional gutter.

5. The improved gutter-downspout connection unit as defined in claim 1, further comprising first and second side tabs, the first side tab adjoining the upper edge of the first upper body side and the second side tab adjoining the upper edge of the second upper body side;

wherein each of the first and second side tabs defines a generally vertical, rectangular plane, has a length substantially equal to the width of the first and second upper body sides, and has a height sufficient to engage sidewalls of a conventional gutter.

6. The improved gutter-downspout connection unit as defined in claim 1, further comprising a portion of a conventional gutter adjoining the top opening of the upper body defined by the upper edges of the first and second upper body sides and the first and second end pieces;

wherein the portion of a conventional gutter comprises a back wall, a front wall and a trough, the trough having an opening therethrough corresponding to and cooperating with the top opening of the upper body such that material contained in the portion of a conventional gutter may pass through the trough opening into the upper body

7. The improved gutter-downspout connection unit as defined in claim 6, wherein the height of the front wall of the portion of conventional gutter is shorter than the height of the front wall of a conventional gutter.

8. The improved gutter-downspout connection unit as defined in claim 1, wherein the first and second upper body sides converge downwardly and inwardly towards each other.

9. The improved gutter-downspout connection unit as defined in claim 1, wherein at least one of the upper body ends has a smooth curvature which is convex inward toward the other upper body end about a longitudinal axis located outside of the upper body.

10. The improved gutter-downspout connection unit as defined in claim 8, wherein at least one of the upper body sides has a smooth curvature which is convex inward toward the other upper body side about a longitudinal axis located outside of the upper body.

* * * * *